US006302350B1

(12) United States Patent
Burrell et al.

(10) Patent No.: US 6,302,350 B1
(45) Date of Patent: Oct. 16, 2001

(54) TOILET TISSUE DISPENSER

(76) Inventors: Renee Burrell; Donald Burrell, both of 1724 17th St., Port Huron, MI (US) 48060

( * ) Notice: Subject to any disclaimer, the term of this patent is extended or adjusted under 35 U.S.C. 154(b) by 0 days.

(21) Appl. No.: 09/376,311

(22) Filed: Aug. 18, 1999

(51) Int. Cl.[7] ..... B65H 19/00

(52) U.S. Cl. ..... 242/560; 242/560.2; 312/34.22; D6/523

(58) Field of Search ..... 242/560, 560.2, 242/560.3; 312/34.22; D6/520, 523; 221/194

(56) References Cited

U.S. PATENT DOCUMENTS

| | | | | |
|---|---|---|---|---|
| D. 306,104 | | 2/1990 | Merdic . | |
| D. 340,375 | | 10/1993 | Hines . | |
| D. 387,590 | | 12/1997 | Cameron et al. . | |
| 2,959,368 | * | 11/1960 | Neff | 242/560 |
| 3,130,932 | * | 4/1964 | Pena | 242/560 |
| 4,098,469 | * | 7/1978 | McCarthy | 242/560 |
| 4,124,259 | * | 11/1978 | Harris | 242/560 |
| 4,146,122 | * | 3/1979 | Harris | 221/194 |
| 4,314,679 | | 2/1982 | Paul et al. . | |
| 4,807,823 | | 2/1989 | Wyant . | |
| 5,868,335 | * | 2/1999 | Lebrun | 242/560.3 |

* cited by examiner

*Primary Examiner*—John Q. Nguyen
(74) *Attorney, Agent, or Firm*—Terrance L. Siemens; Christopher John Rudy

(57) ABSTRACT

A toilet tissue dispenser comprising a housing. An upper front door in the housing lifts upwardly, so that multiple toilet paper rolls can be stacked into the housing. The housing has a lower front notch opening, to allow the lowest toilet paper roll to be removed therefrom.

9 Claims, 3 Drawing Sheets

TOILET TISSUE DISPENSER

BACKGROUND OF THE INVENTION

1. Field of the Invention

The present invention relates generally to bathroom paper holders. More particularly, the invention comprises a toilet tissue dispenser.

In general, a first field of use of the disclosed invention is by homeowners as the most likely benefactors of the unique advantages of the instant invention. However, many other fields, such as restrooms in office buildings, public buildings, restaurants, hotels, move theaters and department stores, could find potentially beneficial uses of this invention.

Thus, it can be seen that the potential fields of use for this invention are myriad, and the particular preferred embodiments described herein are in no way meant to limit the use of the invention to the particular field chosen for exposition of the details of the invention.

A comprehensive listing of all the possible fields to which this invention may be applied is limited only by the imagination and is, therefore, not provided herein. Some of the more obvious applications are mentioned in the interest of providing a full and complete disclosure of the unique properties of this previously unknown general purpose article of manufacture. It is to be understood from the outset that the scope of this invention is not limited to these fields or to the specific examples of potential uses presented herein.

2. Description of the Prior Art

Attempts have been made in the prior art to devise bathroom paper holders that will hold multiple rolls of toilet paper. Bathroom paper holders are shown in U.S. Pat. No. 4,314,679, issued to Dennis J. Paul et al. on Feb. 9, 1982; U.S Pat. No. 4,807,823, issued to James A. Wyant on Feb. 28, 1989; U.S. Pat. No. Des. 306,104, issued to Louis A. Merdic on Feb. 20, 1990; U.S. Pat. No. Des. 340,375, issued to David M. Hines on Oct. 19, 1993; and U.S. Pat. No. Des. 387,590, issued to Allan Cameron et al. on Dec. 16, 1997.

U.S. Pat. No. 4,314,679 to Paul et al. discloses a roll holder and dispenser. It embraces of a container having a first aperture where rolls are inserted and a second aperture from where a web of roll material can be withdrawn. The container is made relatively theft proof by an inwardly angled flange near the first aperture, which allows a roll to be inserted but makes it difficult for the roll to be withdrawn.

U.S. Pat. No. 4,807,823 to Wyant discloses a bathroom tissue dispenser. It has fixed spindles and a lockable hinged enclosure over the top spindle. The enclosure makes it difficult to remove sheets from a top roll until a bottom roll has been depleted.

U.S. Pat. No. Des. 306,104 to Merdic discloses a bathroom toilet tissue dispenser. It embraces a container having a first aperture with a removable top where rolls are inserted and a second notched aperture from where a web of roll material can be withdrawn.

U.S. Pat. No. Des. 340,375 to Hines discloses a toilet tissue dispenser. It has multiple spindles and a lockable hinged front enclosure. The enclosure makes it difficult to remove sheets from a top roll until a bottom roll has been depleted.

U.S. Pat. No. Des. 387,590 to Cameron et al. discloses a toilet paper dispenser. It has multiple spindles and a front enclosure. The enclosure makes it difficult to remove sheets from a top roll until a bottom roll has been depleted.

In addition, the following U.S. patents are cited: Neff, U.S. Pat. No. 2,959,368; Pena, U.S. Pat. No. 3,130,932; McCarthy, U.S. Pat. No. 4,098,469; B. Harris, U.S. Pat. No. 4,124,259; F. Harris, U.S. Pat. No. 4,146,122; and Lebrun, U.S. Pat. No. 5,868,335.

SUMMARY AND OBJECTS OF THE INVENTION

The present invention is a toilet tissue dispenser that comprises of a housing having an upper front door which lifts upwardly, so that multiple toilet paper rolls can be stacked therein and a lower front notch opening to remove the lowest toilet paper roll.

Accordingly, it is a principal object of the invention to provide a toilet tissue dispenser that will overcome the shortcomings of the prior art devices.

Another object of the invention is to provide a toilet tissue dispenser that can be placed upon a counter top to store the multiple toilet paper rolls for future use.

An additional object of the invention is to provide a toilet tissue dispenser that can be mounted upon a wall to store the multiple toilet paper rolls for future use and have a standard toilet paper roll hanger at a bottom end to dispense toilet paper therefrom.

A further object of the invention is to provide a toilet tissue dispenser that is simple and easy to use.

A still further object of the invention is to provide a toilet tissue dispenser that is economical to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the present specification and drawings.

The present invention is completely different than the aforementioned patents to Paul et al., U.S. Pat. No. 4,314,679; to Wyant, U.S. Pat. No. 4,807,823; to Merdic, U.S. Pat. No. Des. 306,104; to Hines, U.S. Pat. No. Des. 340,375; and to Cameron et al., U.S. Pat. No. Des. 387,590; in that it comprises a housing having an upper front door which lifts upwardly so that multiple toilet paper rolls can be stacked therein, and a lower front notch opening to remove the lowest toilet paper roll. None of these patents and other inventions, to include not only these patents to Paul et al., Wyant, Merdic, Hines, and Cameron et al., but also the additional aforementioned patents to Neff, U.S. Pat. No. 2,959,368; Pena, U.S. Pat. No. 3,130,932; McCarthy, U.S. Pat. No. 4,098,469; Harris, U.S. Pat. No. 4,124,259; to Harris, U.S. Pat. No. 4,146,122; and Lebrun, U.S. Pat. No. 5,868,335, taken either singly or in combination, is seen to disclose the instant invention as claimed herein.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
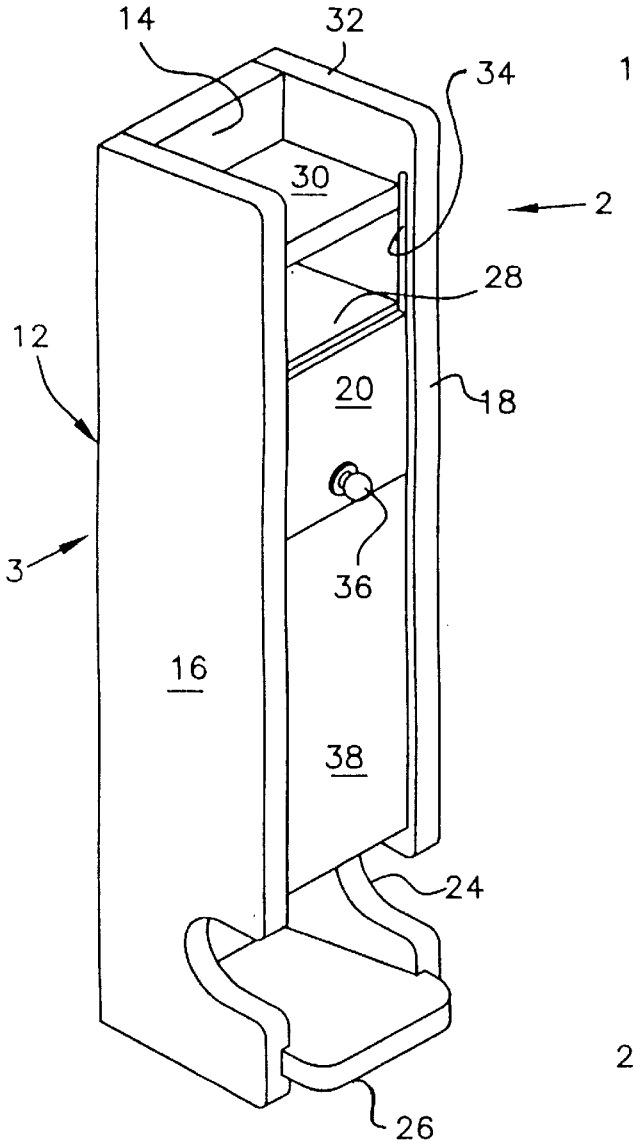
FIG. 1 is a perspective view of a first embodiment of the present invention for use upon a counter top.

Turning now descriptively to the drawings, again in which similar reference characters denote similar elements throughout the several views, FIGS. 1 through 6 illustrate the various components of the present invention being a toilet tissue dispenser 10 comprising a housing 12 having a rear wall 14 and a pair of side walls 16 and 18. An upper front door 20 in housing 12 lifts upwardly, so that multiple toilet paper rolls 22 can be stacked into housing 12. The housing 12 has a lower front notch opening 24 to allow the lowest toilet paper roll 22 to be removed therefrom.

Housing 12 further includes a first shelf 26 located below lower front notch opening 24 to provide a stop for the lowest toilet paper roll 22. A second shelf 28 is located above upper front door 20 when upper front door 20 is in a closed position. A third shelf 30 is located near a top end 32 of housing 12 away from second shelf 28. Housing 12 has side groove tracks 34 for upper front door 20 to ride therein from the closed position to an open position below third shelf 30. A knob 36 is on upper front door 20 to facilitate movement of upper front door 20 in side groove tracks 34 between the closed position to the open position.

Figure 2:
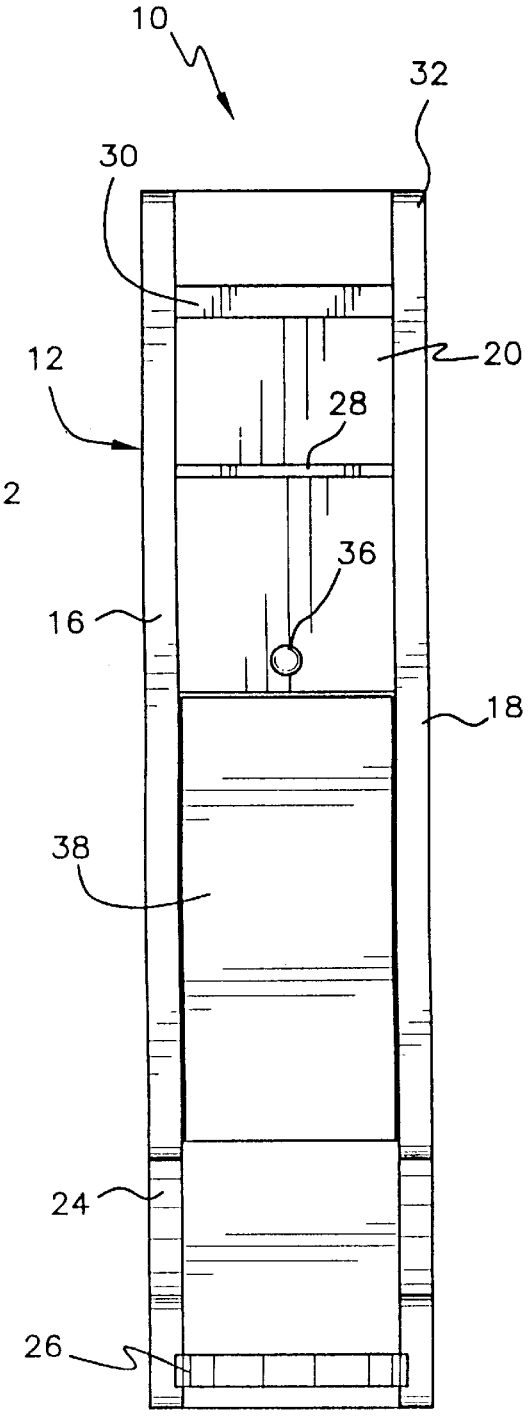
FIG. 2 is a front elevational view taken in the direction of arrow 2 in FIG. 1.
Figure 3:
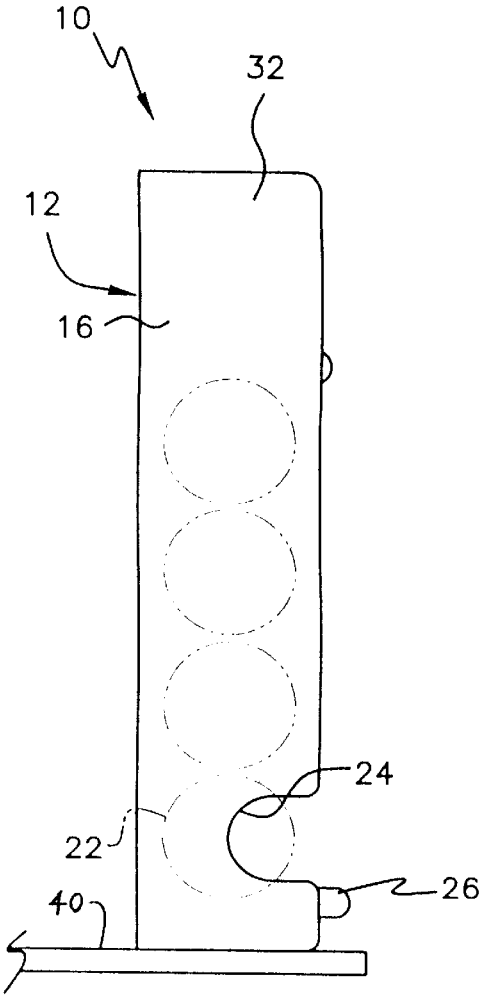
FIG. 3 is a side elevational view taken in the direction of arrow 3 in FIG. 1.

The toilet tissue dispenser 10 in FIGS. 1 through 3 is a first embodiment which contains a solid front panel 38 in housing 12 between upper front door 20 and lower front notch opening 24, wherein housing 12 can be placed upon a counter top 40.

Figure 4:
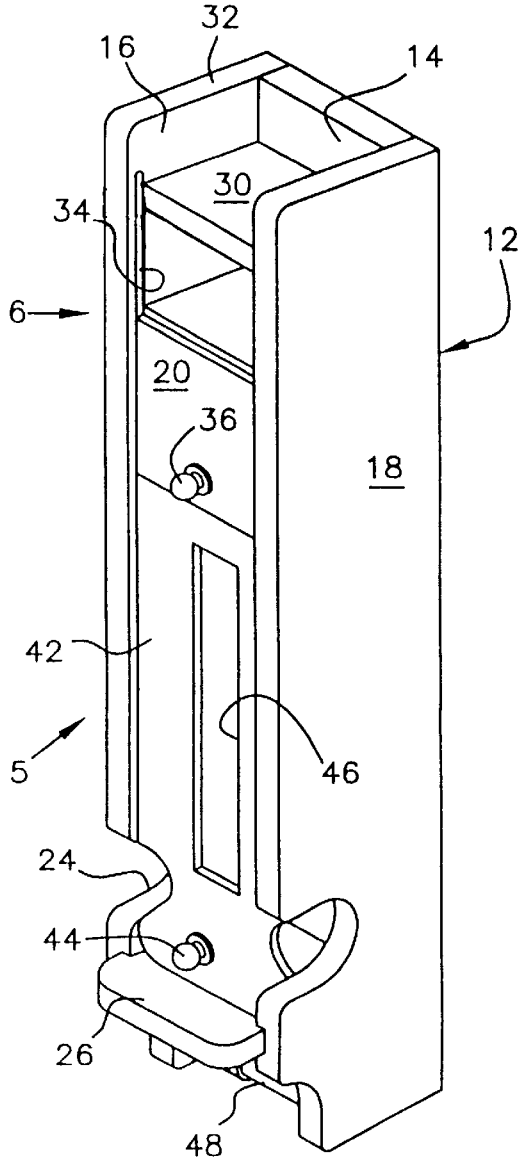
FIG. 4 is a perspective view of a second embodiment of the present invention for use upon a wall.
Figure 5:
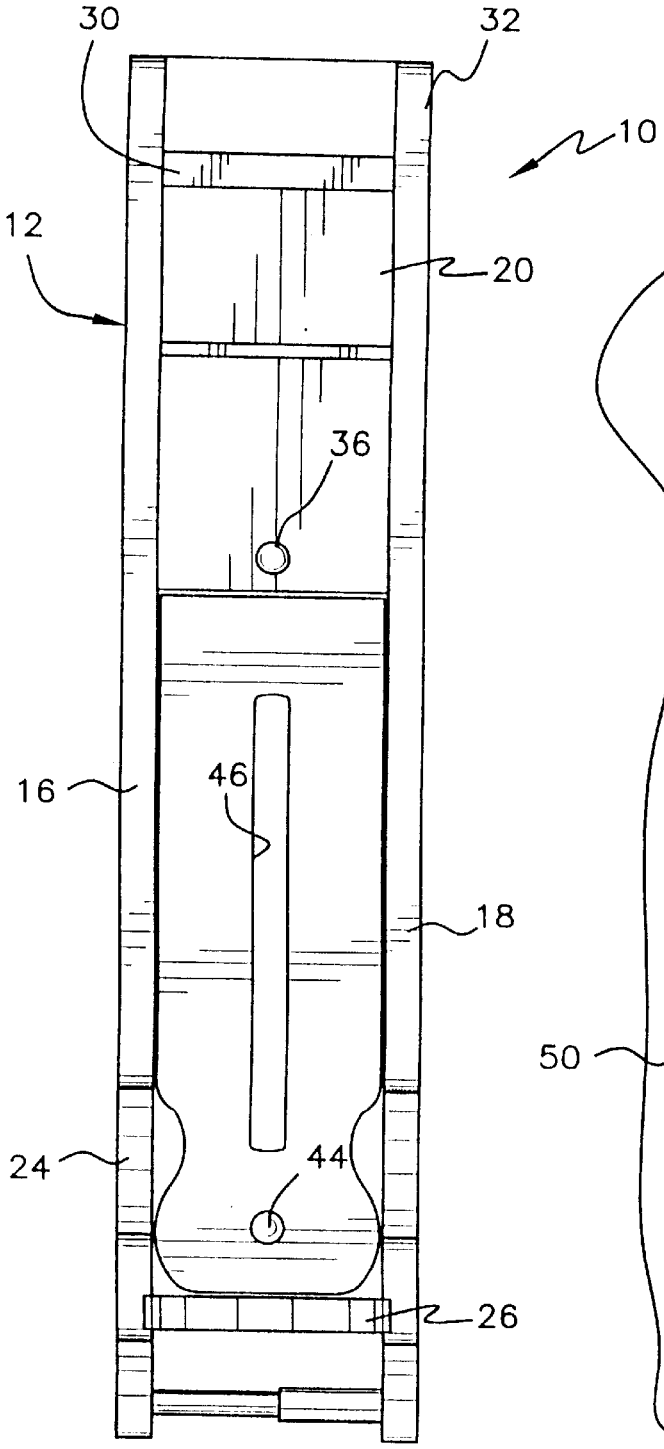
FIG. 5 is a front elevational view taken in the direction of arrow 5 in FIG. 4.
Figure 6:
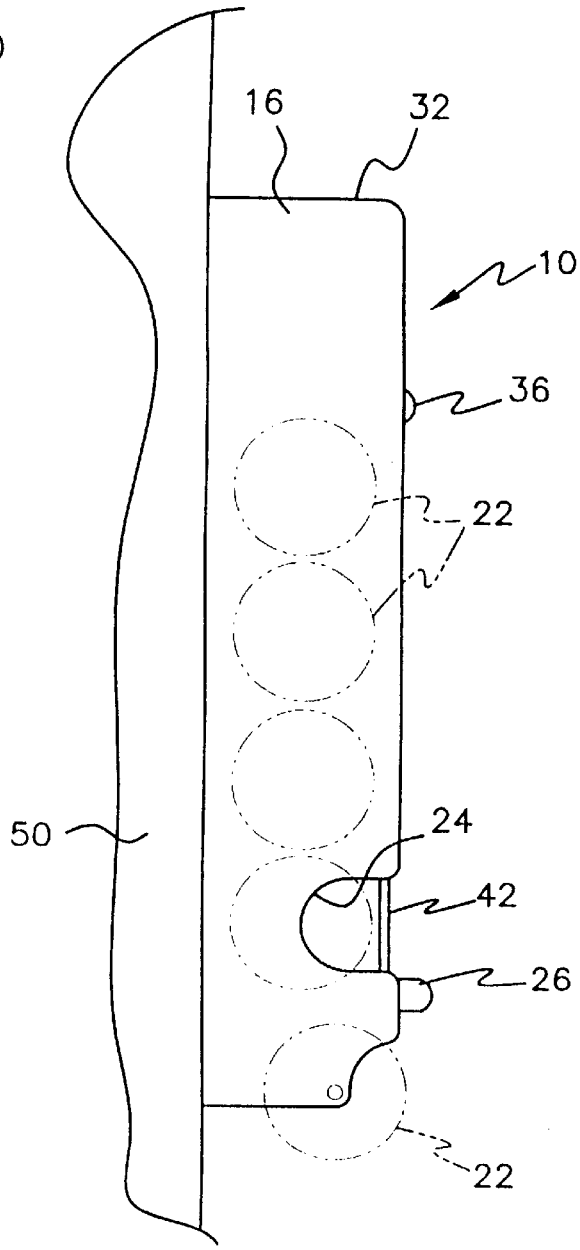
FIG. 6 is a side elevational view taken in the direction of arrow 6 in FIG. 4.

The toilet tissue dispenser 10 in FIGS. 4 through 6 is a second embodiment which comprises a lower front door 42 in housing 12, which rides within side groove tracks 34 below upper front door 20 and extends down into lower front notch opening 24 against first shelf 26. A knob 44 is on lower front door 42 to facilitate movement of lower front door 42 in side groove tracks 34 between a closed position to an open position, to remove the lowest toilet paper roll 22 from lower front notch opening 24 in housing 12. Lower front door 42 has a vertical slot 46 to see a supply of toilet paper rolls 22 stacked into housing 12. A standard toilet paper roll hanger 48 is located in housing 12 below first shelf 26, wherein housing 12 can be mounted upon a wall 50.

To use toilet tissue dispenser 10 in FIGS. 1 through 3, a person simply places housing 12 in a vertical position upon counter 40. Upper front door 20 is lifted by knob 36 to the open position. Toilet paper rolls 22 are then inserted in a stacked condition into housing 12, See, FIG. 3.

To use toilet tissue dispenser 10 in FIGS. 4 through 6, a person simply mounts housing 12 upon wall 50. Upper front door 20 is lifted by knob 36 to the open position. Toilet paper rolls 22 are then inserted in a stacked condition into housing 12. One toilet paper roll 22 is then placed on standard toilet paper roll hanger 48. When toilet paper roll 22 is used up on standard toilet paper roll hanger 48, it can be replaced by lifting lower front door 42 by knob 44 and removing lowest toilet paper roll from housing 12 and placing it on standard toilet paper roll hanger 48, See FIG. 6.

It is to be understood that the present invention is not limited to the embodiments described above, but encompasses any and all embodiments within the scope of the following claims.

What is claimed is:

1. A toilet tissue dispenser comprising:

a hollow housing including vertically oriented front, back and opposing side walls, and a lower, first shelf to provide a stop on which a toilet paper roll, which generally has opposing, parallel faces perpendicular to a cylindrical outer boundary and a central axis, can rest, with the central axis of the toilet paper roll essentially parallel with the front and back walls of the housing;

a set of opposing, internally facing, vertically oriented side groove tracks at least in an upper, front portion of the side walls;

an upper front door mounted in said set of groove tracks in the side walls of said housing, which can ride upwardly and downwardly in said set of groove tracks between open and closed positions, so that, when the upper front door is open, multiple toilet paper rolls can be inserted into and stacked, one on top of and in contact with one another in, and with a lowest toilet paper roll resting on the lower shelf of, said housing; and a lower front notch opening in each of the side walls above the lower shelf of said housing to allow the lowest toilet paper roll to be grasped on the opposing faces of the lowest toilet paper roll and removed therefrom, whereupon a succeeding toilet paper roll from inside said housing drops down into place upon the lower shelf;

the toilet tissue dispenser further including:

a set of opposing, internally facing, vertically oriented side groove tracks in a lower, front portion of the side walls; and a lower front door in said housing which rides within the set of opposing, internally facing, vertically oriented side groove tracks in the lower, front portion of the side walls below the upper front door and which extend down through the lower front notch openings and down to the lower shelf;

wherein the lower front door in said set of lower side groove tracks can be moved between a closed position to an open position to remove the lowest toilet paper roll from the lower shelf by inserting a user's hand through the lower front notch openings in said housing to grasp the opposing faces of the lowest toilet paper roll and remove the lowest toilet paper roll therefrom.

2. The toilet tissue dispenser of claim 1, wherein said lower front door has a vertical slot to see a supply of toilet paper rolls stacked in said housing.

3. The toilet tissue dispenser of claim 1, further including a standard toilet paper roll hanger located in said housing below the lower shelf, wherein said housing can be mounted on a wall.

4. The toilet tissue dispenser of claim 1, wherein the upper and lower sets of opposing groove tracks are coextensive.

5. The toilet tissue dispenser of claim 4, further including a knob on said upper front door to facilitate movement of this upper door between said closed and open positions, and a knob on said lower front door to facilitate movement of this lower door between said closed and open positions.

6. The toilet tissue dispenser of claim 1, further including a knob on said upper front door to facilitate movement of this upper door between said closed and open positions, and a knob on said lower front door to facilitate movement of this lower door between said closed and open positions.

7. The toilet tissue dispenser of claim 1, wherein said housing further includes:

a second shelf located above the upper front door when the upper front door is in a closed position; and a third shelf located near a top end of said housing and spaced away from said second shelf.

8. The toilet tissue dispenser of claim 7, wherein the upper front door rides downwardly to the closed position and upwardly to an open position below said third shelf.

9. The toilet tissue dispenser of claim 1, wherein said housing can be placed upon a counter top and is structured to remain vertically oriented.

* * * * *